US010310542B2

(12) United States Patent
Butler et al.

(10) Patent No.: US 10,310,542 B2
(45) Date of Patent: Jun. 4, 2019

(54) OPERATOR MECHANISM FOR CONTROL ENCLOSURE

(71) Applicant: Eaton Intelligent Power Limited, Dublin OT (IE)

(72) Inventors: Andrew James Butler, Baldwinsville, NY (US); Graig Edmund DeCarr, Cicero, NY (US); Joseph Michael Manahan, Manlius, NY (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/893,046

(22) Filed: Feb. 9, 2018

(65) Prior Publication Data

US 2018/0232004 A1 Aug. 16, 2018

Related U.S. Application Data

(60) Provisional application No. 62/457,313, filed on Feb. 10, 2017.

(51) Int. Cl.

| | |
|---|---|
| ***G05G 1/00*** | (2006.01) |
| ***G05G 1/02*** | (2006.01) |
| ***G05G 1/54*** | (2008.04) |
| ***G05G 1/08*** | (2006.01) |

(52) U.S. Cl.

CPC ..... *G05G 1/54* (2013.01); *G05G 1/02* (2013.01); *G05G 1/025* (2013.01); *G05G 1/08* (2013.01)

(58) Field of Classification Search

CPC ..... G05G 1/02; G05G 1/025; G05G 1/08; G05G 1/087; G05G 1/10; G05G 1/12; G05G 1/54; H01H 3/02; H01H 3/08; H01H 3/10; H01H 3/12; H01H 3/54; H01H 2003/127

See application file for complete search history.

(56) References Cited

U.S. PATENT DOCUMENTS

| | | | | |
|---|---|---|---|---|
| 2,806,099 A * | 9/1957 | Rexroad | ..... | H01H 9/22 200/43.14 |
| 3,392,593 A | 7/1968 | Paape et al. | | |
| 3,522,403 A | 8/1970 | Fuller | | |
| 4,540,864 A * | 9/1985 | Krasser | ..... | H01H 3/12 200/302.2 |
| 5,634,553 A | 6/1997 | Hopper et al. | | |

(Continued)

OTHER PUBLICATIONS

International Search Report and Written Opinion for PCT/US2018/017622, 12 pages.

*Primary Examiner* — Adam D Rogers

(74) *Attorney, Agent, or Firm* — Stinson Leonard Street LLP

(57) ABSTRACT

An operator mechanism for a control enclosure includes a shaft assembly having an adjustable length. A shaft extender may be selectively slidable longitudinally along an operator shaft to selectively adjust the length of the shaft assembly, and selectively lockable on the operator shaft to inhibit sliding of the shaft extender on the operator shaft to retain a selected length of the shaft assembly. A shaft extender may be received in a longitudinal passage of a mount sleeve and extend distally outward from the mount sleeve. The shaft extender may be selectively movable longitudinally within a longitudinal passage of the mount sleeve relative to a shaft operator to selectively adjust the length of the shaft assembly.

20 Claims, 14 Drawing Sheets

(56) References Cited

U.S. PATENT DOCUMENTS

| | | | | |
|---|---|---|---|---|
| 6,974,922 | B2 * | 12/2005 | Bortolloni | H01H 9/22 200/50.05 |
| 7,772,510 | B2 * | 8/2010 | Manahan | H01H 3/08 200/50.02 |
| 8,353,498 | B2 * | 1/2013 | Fukano | F16K 7/16 251/79 |
| 8,382,621 | B2 * | 2/2013 | Chen | F16K 31/05 475/4 |
| 8,908,357 | B2 * | 12/2014 | Manahan | H01H 3/54 200/331 |
| 2015/0053537 | A1 | 2/2015 | Manahan | |

* cited by examiner

OPERATOR MECHANISM FOR CONTROL ENCLOSURE

CROSS-REFERENCE TO RELATED APPLICATIONS

The present application claims priority to U.S. Provisional Application No. 62/457,313, filed Feb. 10, 2017, the entirety of which is hereby incorporated by reference.

FIELD OF THE DISCLOSURE

The present disclosure generally relates to an operator mechanism for a control enclosure.

BACKGROUND OF THE DISCLOSURE

Operator mechanisms are used to interface with control systems housed within control enclosures. Such operator mechanisms include, for example, push buttons, rotary switches, and swing handles, among others. The operator mechanisms are mounted on a wall (e.g., door) of the control enclosures to allow an operator to actuate the operator mechanism from outside the enclosure to perform some operation with the components housed in the enclosure.

One type of conventional operator mechanism is illustrated in FIGS. 1A and 1B. This operator mechanism, generally indicated at reference numeral 1, is shown mounted on a door 2 of a control enclosure, generally indicated at 6. The operator mechanism 1 includes button 3, an operator shaft 5 coupled to the button, and a threaded nylon extender 7 threaded on a distal end of the operator shaft. The longitudinal position of the nylon extender 7 on the operator shaft can be adjusted to a desired position so that the nylon extender engages a switch 8 or other feature in the control enclosure when the button 3 is depressed (i.e., when the button is pushed inward toward the door 2). In effect, the length of the operator mechanism 1 is adjustable to meet the different configurations of control enclosures. A jam nut 9 is also threaded on the operator shaft 5 to selectively inhibit longitudinal movement of the nylon extender 7 on the operator shaft once a user has the nylon extender in the desired position on the operator shaft.

It may be difficult and time-consuming to properly adjust the length conventional operator mechanism 1 when installing on the door 2 of the control enclosure 6. It may take several attempts of the user taking measurements and opening and closing the door 2 to correctly adjust the length of the operator mechanism 1. As can be understood from FIG. 1A, a measurement must be taken to determine the distance from a flange 4 to the switch 8. Then the length of the operator mechanism 1 must be measured and adjusted so that the nylon extender 7 will be slightly spaced from the switch 8 when the door 2 is closed. If any measurements are off, even slightly, the process must be repeated. Moreover, this process must be repeated for each operator mechanism installed on the door 2, and thus, becomes even more challenging and time consuming when numerous components are installed in the control enclosure 6.

SUMMARY OF THE DISCLOSURE

In one aspect, an operator mechanism for a control enclosure generally comprises a mechanical user interface configured to be physically moved by a user to actuate the operator mechanism; and a shaft assembly coupled to the mechanical user interface such that movement of the mechanical user interface imparts movement to the shaft assembly. The shaft assembly has a length, and includes an elongate operator shaft having a longitudinal axis extending distally outward from the mechanical user interface, and a shaft extender coupled to the operator shaft and having an axis extending along the operator shaft. The shaft extender is selectively slidable longitudinally along the operator shaft to selectively adjust the length of the shaft assembly, and selectively lockable on the operator shaft to inhibit sliding of the shaft extender on the operator shaft to retain a selected length of the shaft assembly.

In another aspect, an operator mechanism for a control enclosure generally comprises a mechanical user interface configured to be physically moved by a user to actuate the operator mechanism. A shaft assembly is coupled to the mechanical user interface such that movement of the mechanical user interface imparts movement to the shaft assembly. The shaft assembly has a length, and includes an elongate operator shaft having a longitudinal axis extending distally outward from the mechanical user interface, and a shaft extender coupled to the operator shaft and having an axis extending along the operator shaft, wherein the shaft extender is selectively movable along the operator shaft to selectively adjust the length of the shaft assembly. A mount sleeve facilitates mounting of the operator mechanism on a wall of the control enclosure. The mount sleeve defines a longitudinal passage extending therethrough. The shaft extender is received in the longitudinal passage of the mount sleeve and extends distally outward from the mount sleeve. The shaft extender is selectively movable longitudinally within the longitudinal passage of the mount sleeve relative to the shaft operator to selectively adjust the length of the shaft assembly.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

Figure 1A:
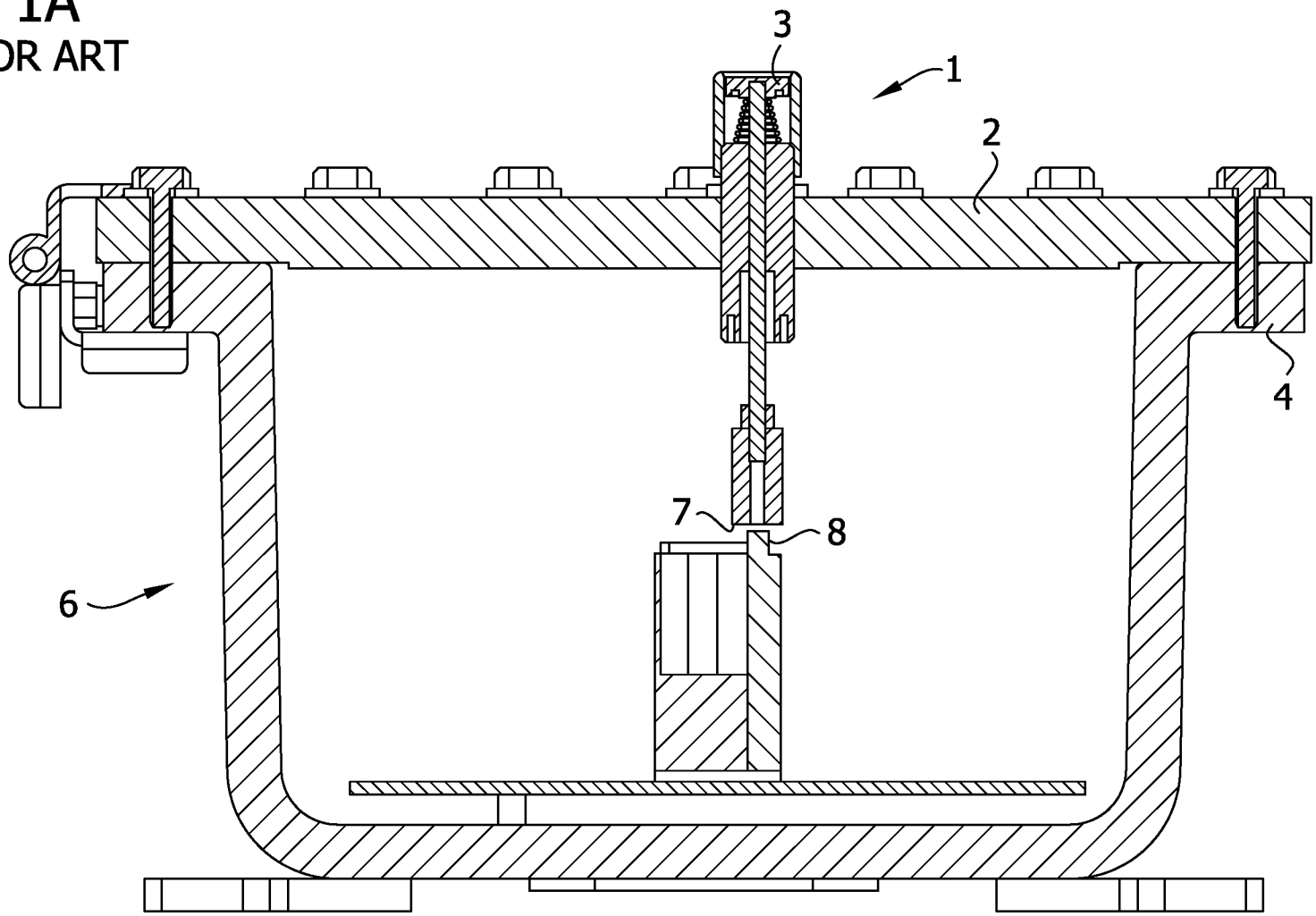
FIG. 1A PRIOR ART
FIG. 1A is a cross section of a control enclosure including a conventional operator mechanism mounted on a door of the control enclosure.
Figure 1B:
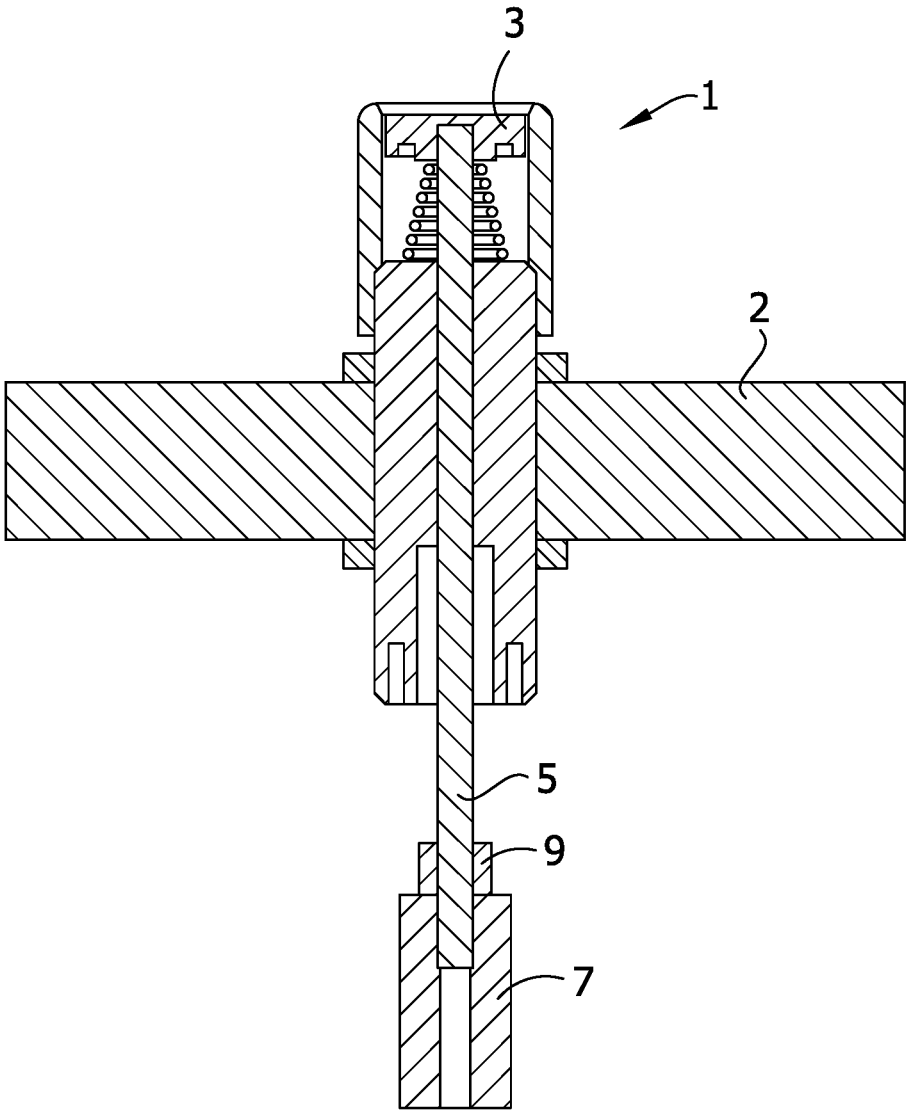
FIG. 1B PRIOR ART
FIG. 1B is an enlarged view of the conventional operator mechanism mounted on the door of the control enclosure.
Figure 2:
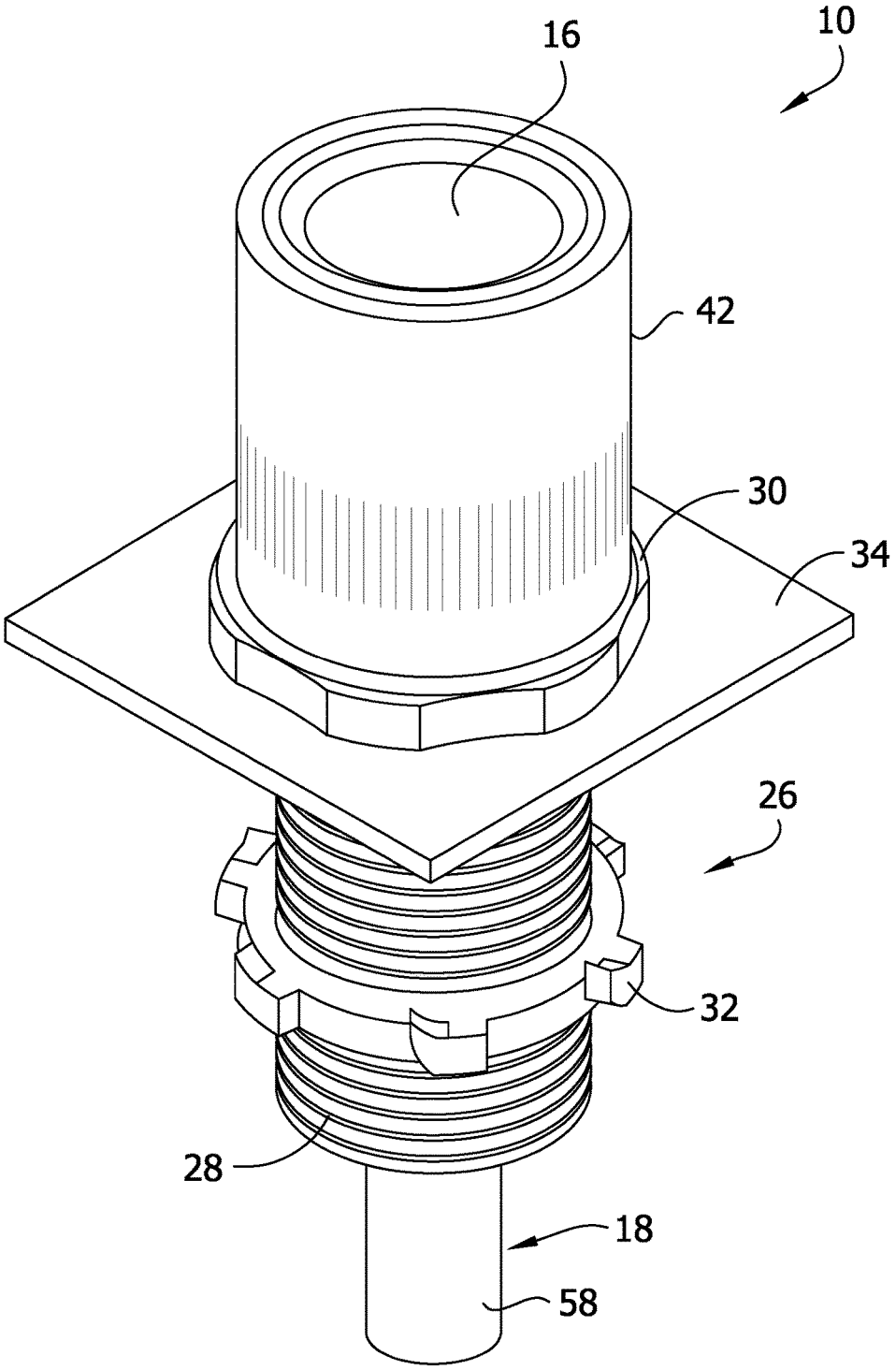
FIG. 2 is a perspective of one embodiment of an operator mechanism constructed according to the teachings of the present disclosure.
Figure 6:
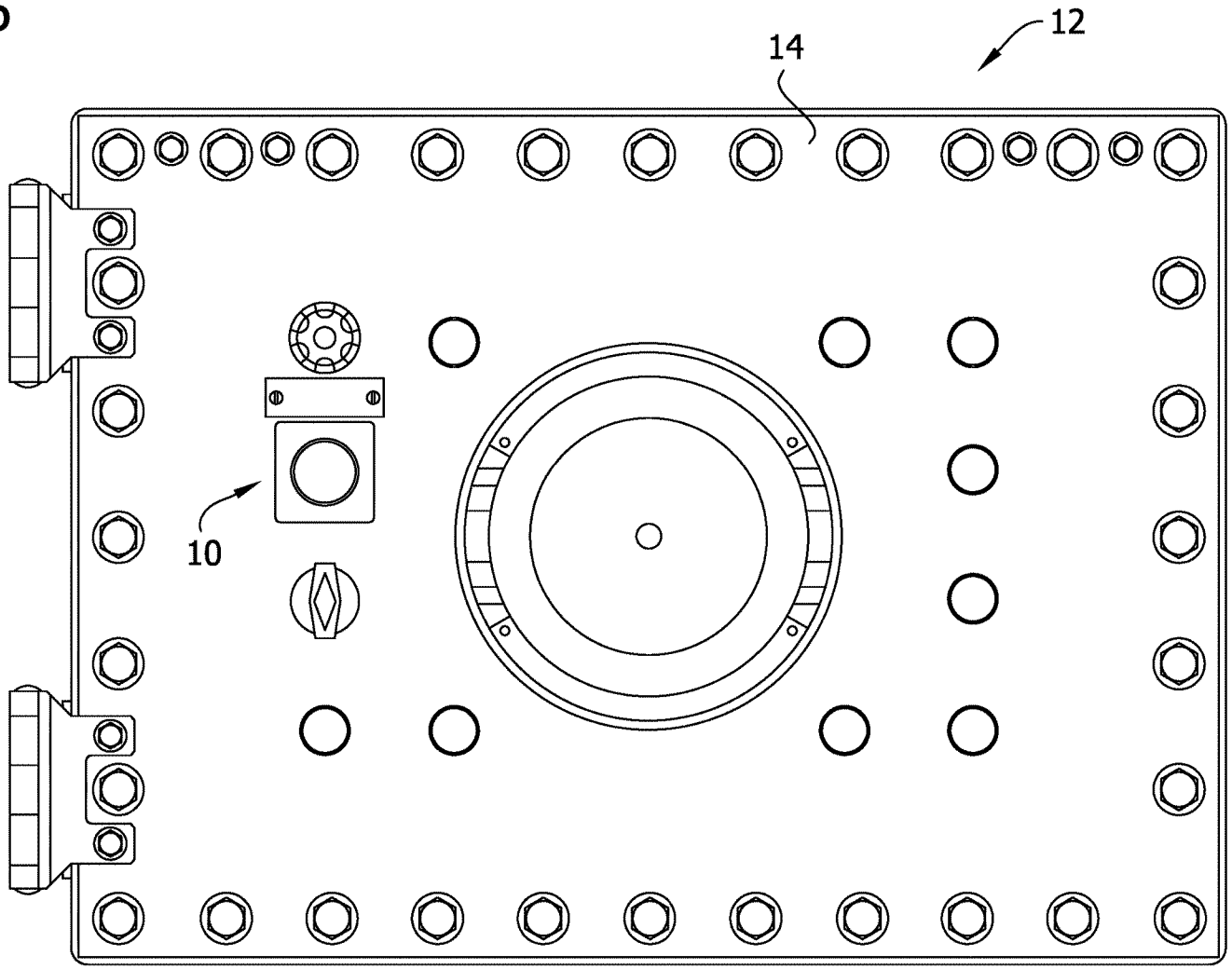
FIG. 6 is a front elevation of a control enclosure with the operator mechanism of FIG. 2 mounted on a closed door thereof.
Figure 7:
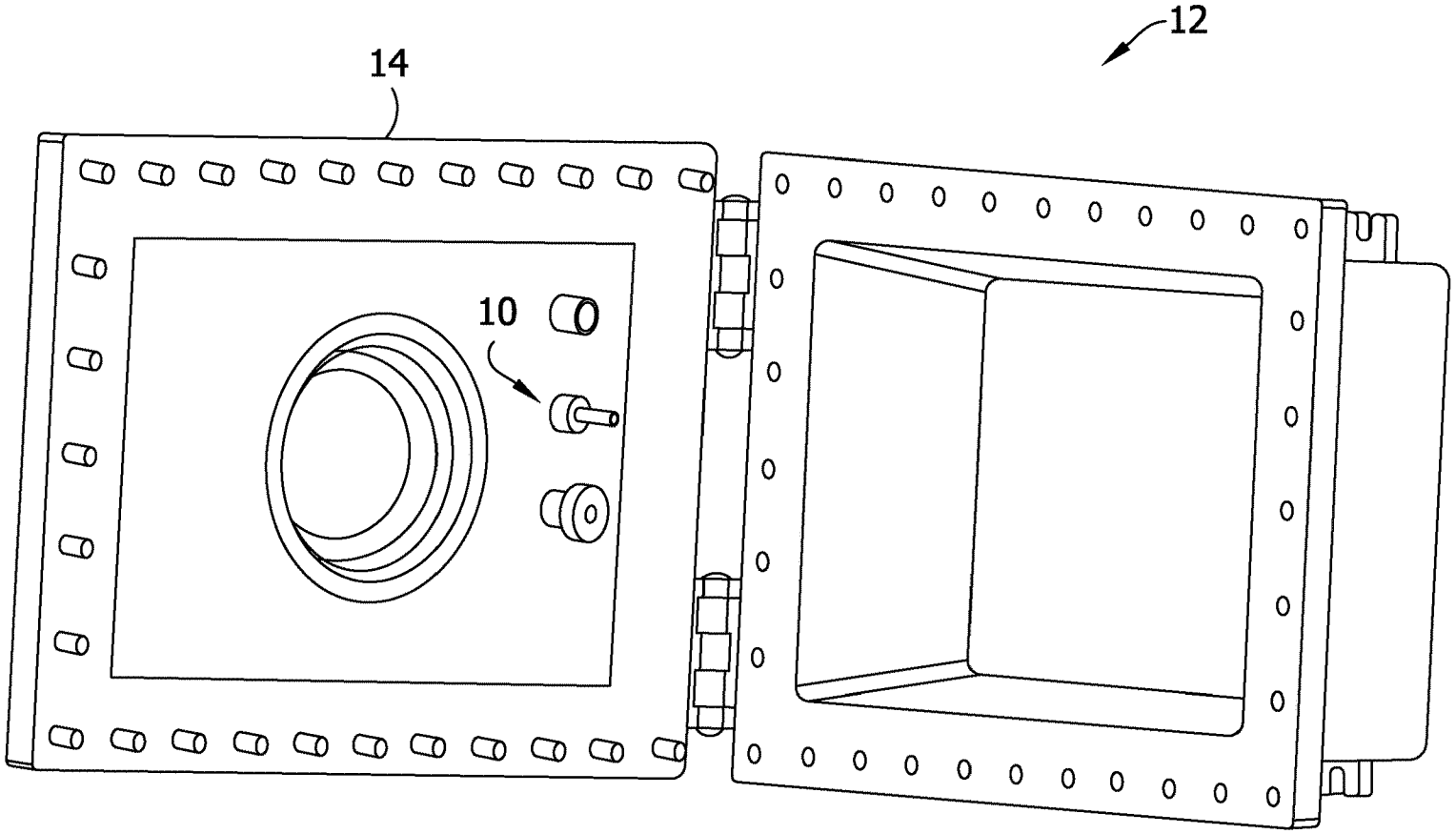
FIG. 7 is a perspective of the control enclosure of FIG. 6 with the door open.

Referring to FIG. 2 of the drawings, an operator mechanism for a control enclosure is generally indicated at reference numeral 10. The operator mechanism 10 is configured to be mounted on a control enclosure, such as the illustrated enclosure generally indicated at reference numeral 12 illustrated in FIGS. 6 and 7. As is generally known in the art, the control enclosure 12 may house electrical controls or other electrical components for controlling and/or operating devices and systems. For example, in one embodiment the control enclosure may be configured to house a motor controller, such as a motor starter. In a particular embodiment, the control enclosure 12 may be an explosion proof enclosure. The enclosure 12 includes one or more walls defining the enclosure, and in one embodiment, the enclosure includes a door 14, as shown in FIGS. 6 and 7. The operator mechanism 10 may be mounted on the door 14 or other wall of the enclosure 12.

Figure 12:
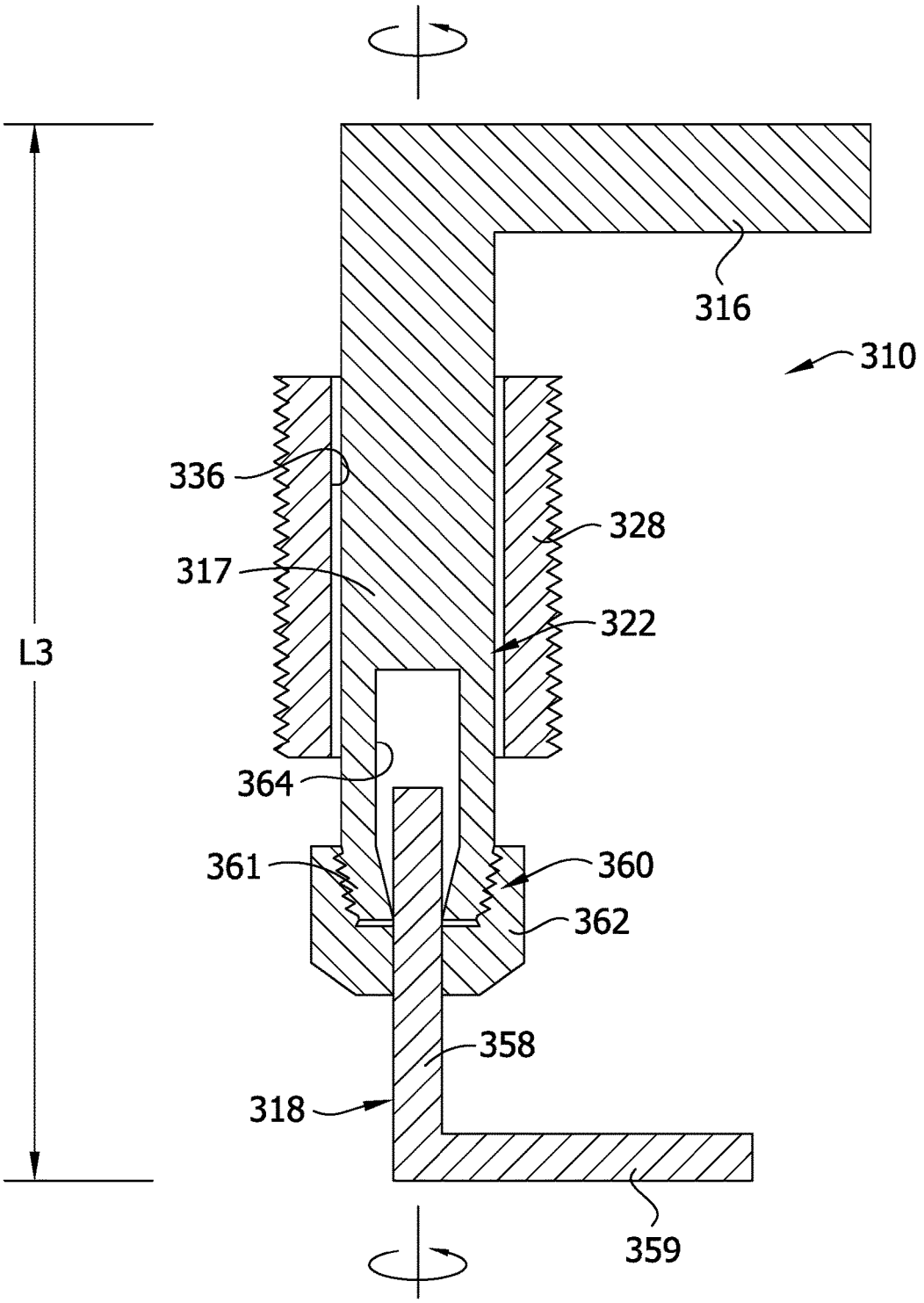
FIG. 12 is a longitudinal section of another embodiment of an operator mechanism constructed according to the teachings of the present disclosure.
Figure 13:
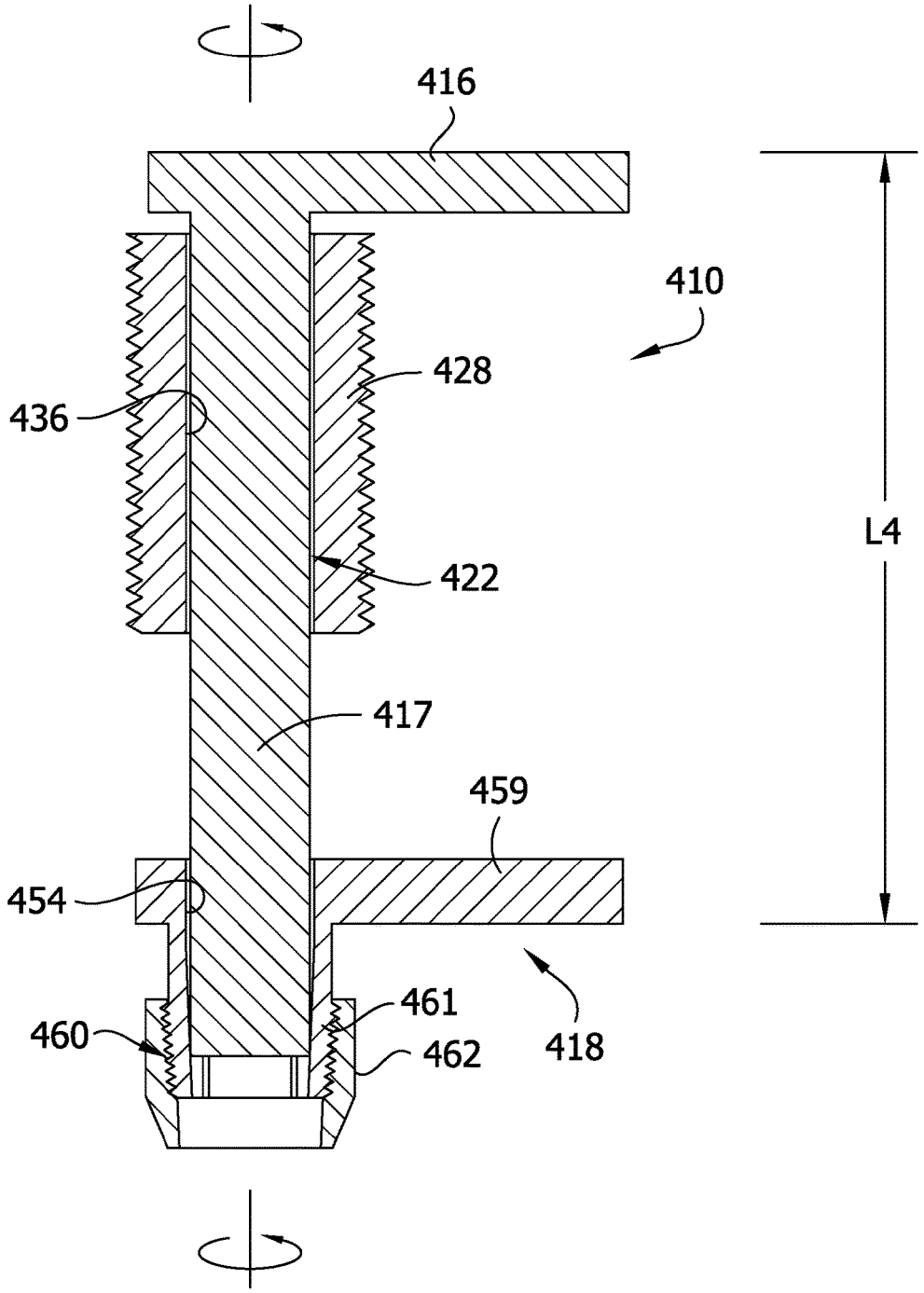
FIG. 13 is a longitudinal section of yet another embodiment of an operator mechanism constructed according to the teachings of the present disclosure.

In generally, and as explained in more detail below, the operator mechanism 10 is selectively adjustable in operative length to allow the operator mechanism to be used with different types of control enclosures and/or different types of controllers and other electrical components housed within the control enclosure. The illustrated operator mechanism 10 is configured as a push button operator mechanism. It is understood that the teachings set forth herein may be employed in other operator mechanism embodiments, including a rotary switch operator mechanism (examples of which are illustrated in FIGS. 12 and 13 and explained in more detail below) and swing handle operator mechanisms, for example.

Figure 3:
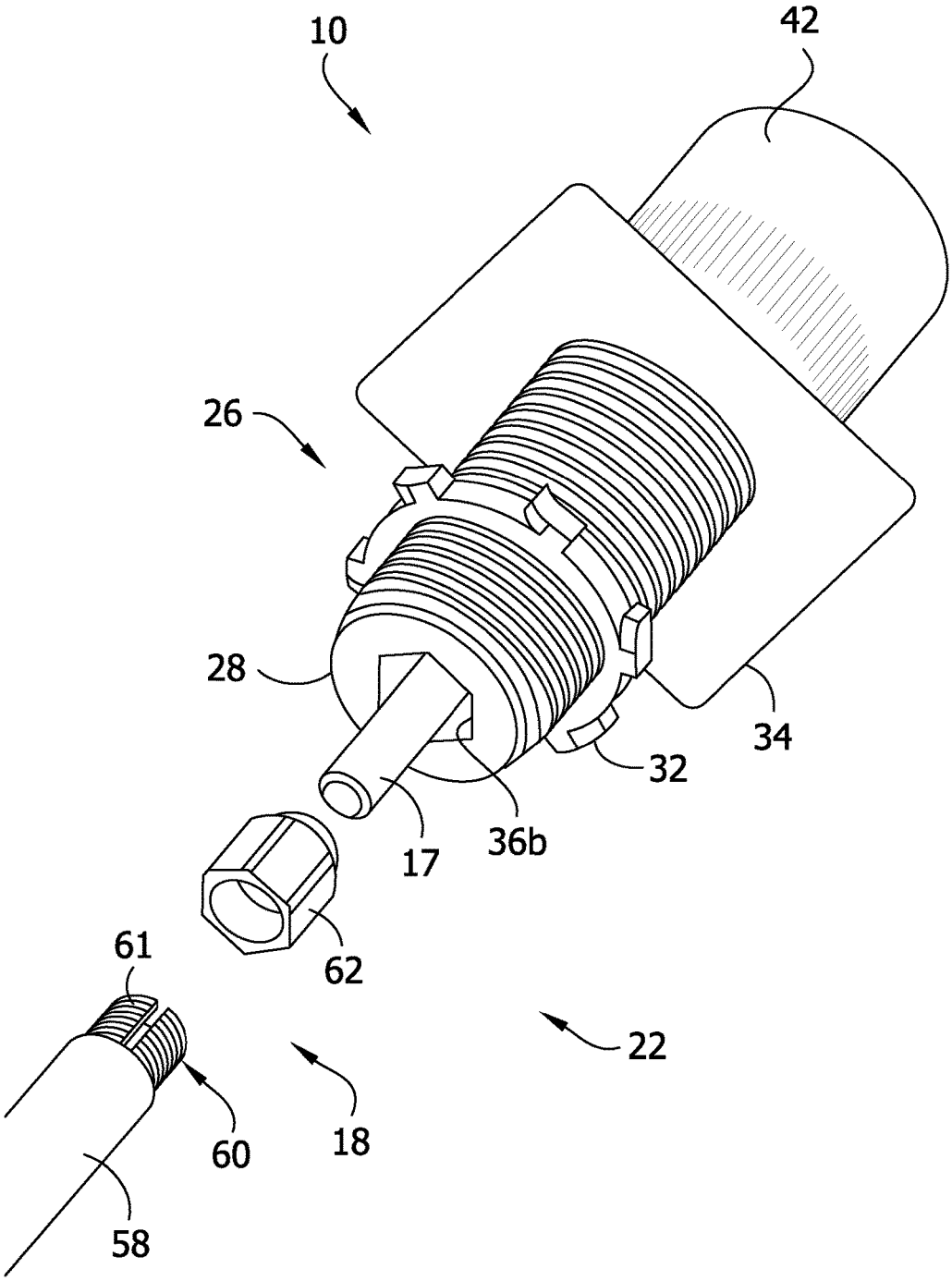
FIG. 3 is an exploded perspective of the operator mechanism of FIG. 2.
Figure 4:
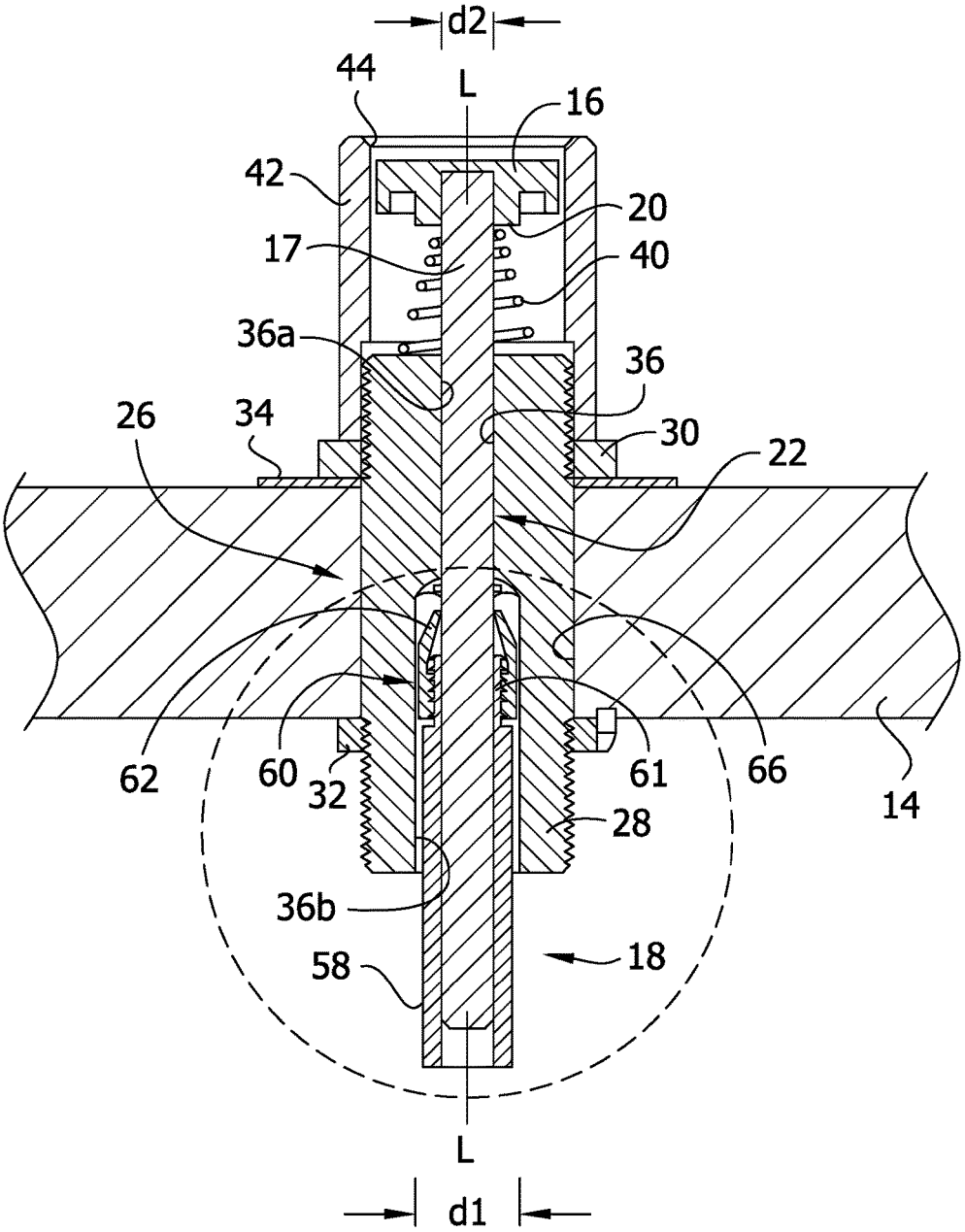
FIG. 4 is a longitudinal section of the operator mechanism of FIG. 2.

As shown best in FIGS. 3 and 4, the illustrated push button operator mechanism 10 comprises a button 16, an operator shaft 17 extending distally outward from the button, and a shaft extender, generally indicated at 18, coupled to the operator shaft. As used herein, the terms "proximal," "distal," and like terms, are used for convenience to describe relative positions and locations of the components and structures of the operator mechanism 10 and are not meant in a limiting sense. The illustrated button 16 comprises a disc-shaped body having a proximal face that is accessible by an operator. A proximal end of the operator shaft 17 is secured in an opening defined by a boss 20 (FIG. 4) at a distal face of the disc-shaped body of the button 16. Referring to FIG. 4, together, the operator shaft 17 and the shaft extender 18 are components of a shaft assembly, generally indicated at 22, which may include additional components. The shaft assembly 22 has a longitudinal axis L.

As shown in FIGS. 2-4, an operator mount, generally indicated at 26, of the operator mechanism 10 is configured to mount the operator mechanism on a wall (e.g., door 14) of the control enclosure 12. The operator mount 26 includes a mount sleeve 28 that is externally threaded, and proximal and distal mount nuts (e.g., jam nuts) 30, 32, respectively, threaded on proximal and distal portions of the sleeve, respectively. A face plate 34 disposed between the jam nuts 30, 32 is configured to seat against the exterior surface of the wall (e.g., door 14), as shown in FIG. 4. Referring to FIG. 4, the shaft assembly 22 extends through a longitudinal passage 36 defined in the mount sleeve 28, such that a proximal portion of the shaft assembly (e.g., the operator shaft 17) extends proximally outward from a proximal end of the mount sleeve, and a distal portion of the shaft assembly (e.g., the operator shaft 17 and/or the shaft extender 18) extends distally outward from a distal end of the mount sleeve. The shaft assembly 22 is longitudinally movable (e.g., slidable) within the longitudinal passage 36 of the mount sleeve 28 between a proximal (i.e., initial or non-depressed) position and a distal (i.e., depressed) position. A spring 40 (e.g., a compression spring) is disposed between the button 16 and the proximal end of the mount sleeve 28 to bias the shaft assembly 22 in its proximal position. The illustrated spring 40 is a coiled compression spring surrounding the proximal portion of the operator shaft 17. A button shroud 42 is threaded on the proximal portion of the mount sleeve 28 to protect the button 16. An opening 44 in the proximal end of the shroud 42 allows access to the button 16.

Figure 5:
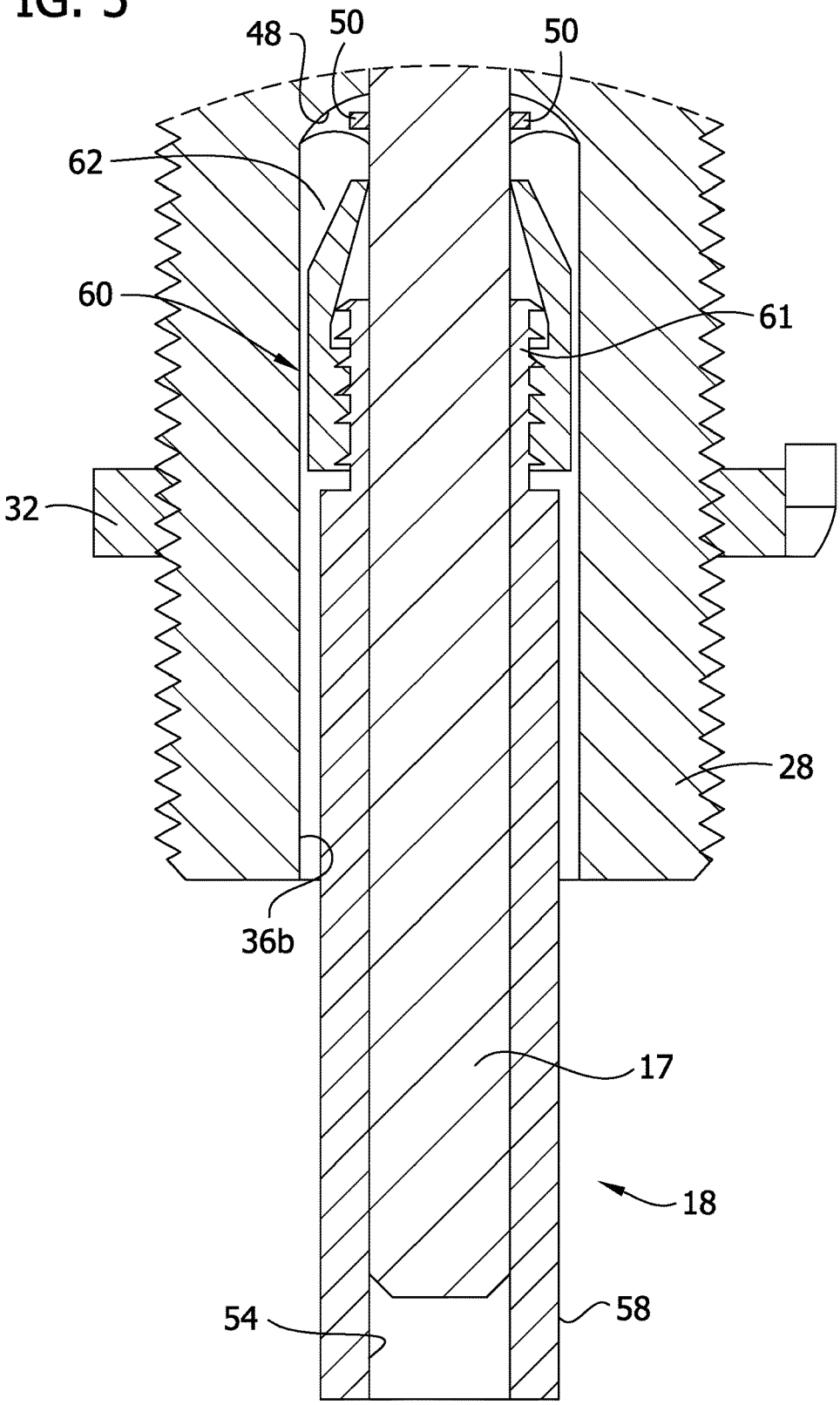
FIG. 5 is an enlarged, fragmentary view of the operator mechanism as indicated in FIG. 4.

In the illustrated embodiment, the longitudinal passage 36 in the mount sleeve 28 includes coaxial proximal and distal portions 36*a*, 36*b*, respectively. The proximal portion 36*a* of the longitudinal passage 36 extends through a proximal end of the mount sleeve 28 and terminates at a location intermediate the proximal and distal ends thereof. The distal portion 36*b* of the longitudinal passage 36 extends from the distal end of the proximal portion 36*a* of the longitudinal passage through the distal end of the mount sleeve 28. The distal portion 36*b* of the longitudinal passage 36 has a cross-sectional dimension d1 that is greater than a cross-sectional dimension d2 of the proximal portion 36*a* to define an internal shoulder 48 (FIG. 5) at the juncture of the distal and proximal portions. As shown best in FIG. 5, stop 50 located on the operator shaft 17 (e.g., a ring surrounding the operator shaft or a pin extending transversely through the operator shaft), at a location proximal of the shaft extender 18, contacts the internal shoulder 48 to inhibit the shaft assembly 22 from moving proximally beyond its initial position or another desired proximal position. The operator mechanism 10 may include other structures and/or components to inhibit the shaft assembly 22 from moving proximally beyond a desired longitudinal position.

The shaft extender 18 is selectively slidable longitudinally along a distal end portion of the operator shaft 17 to adjust the length of the shaft assembly 22. A distal portion of the operator shaft 17 is received in a passage 54 extending longitudinally through the shaft extender 18 to allow the shaft extender to be selectively slidable longitudinally along the operator shaft. The shaft extender 18 is also selectively lockable at an infinite number of longitudinal locations along the length of the operator shaft 17 to inhibit longitudinal movement of the shaft extender along the operator shaft to maintain the selected and desired length of the shaft assembly 22. In the illustrated embodiment, the shaft extender 18 includes an elongate shaft body 58, a threaded collet 60 at a proximal end of the shaft body, and a collet nut 62 threaded on the collet. The illustrated collet 60 includes a plurality fingers 61 circumferentially spaced apart from one about the longitudinal axis L of the shaft assembly 22. The fingers 61 are biased in a radially outward direction and movable radially inward relative to the longitudinal axis L of the shaft assembly to grip the operator shaft 17. Loosening the collet nut 62 on the collet 60 allows the fingers 61 to move toward their biased radially outward position to release or lessen their frictional grip on the operator shaft 17, which allows the shaft extender 18 to be slidable longitudinally along the distal end portion of the operator shaft 17. Tightening the collet nut 62 on the collet 60 moves the fingers 61 radially inward toward the operator shaft 17 to grip and frictionally engage the shaft. The collet nut 62 can be tightened (or loosened) to one or more first positions so that the collet 60 grips the operator shaft 17 but still allows selective sliding longitudinal movement of the shaft extender 18 on the operator shaft 17 when a threshold force is applied to the shaft extender. The collet nut 62 can be tightened to one or more second positions to tighten the grip of the collet 60 on the operator shaft 17 and inhibit sliding longitudinal movement of the shaft extender 18 on the operator shaft during use (e.g., when the button 16 is depressed and the distal end of the extender body 18 contacts a switch in the control enclosure 12).

In the illustrated embodiment, when the collet nut 62 is received in the distal portion of the longitudinal passage 36 of the mount sleeve 28, the collet nut is inhibited from rotating relative to the mount sleeve (and relative to the operator shaft 17) about the longitudinal axis L, while the collet 60 and the extender body 58 are capable of rotating relative to the mount sleeve (and the operator shaft) about the longitudinal axis L regardless of whether the extender body is within the longitudinal passage of the mount sleeve or outside the mount sleeve. Accordingly, when the collet nut 62 is received in the distal portion 36*b* of the longitudinal passage 36 of the mount sleeve 28 and at least a portion of the extender body 58 is exposed and extending distally outward from the mount sleeve, the operator can grip and rotate the exposed portion of extender body about the longitudinal axis L to selectively tighten and/or loosen the collet nut on the collet 60. The collet nut 62 can also be tightened and/or loosened on the collet 60 when the collet nut is outside the longitudinal passage 36 of the mount sleeve 28, such as by using a tool (e.g., a wrench) or one's hands.

In the illustrated embodiment, the geometries of the collet nut 62 and the distal portion 36*b* of the longitudinal passage 36 of the mount sleeve 28 inhibit the collet nut from rotating about its axis within the passage. As illustrated, the collet nut has a polygonal exterior cross-sectional shape (e.g., hexagonal), and the distal portion 36*b* of the longitudinal passage 36 of the mount sleeve 28 has a corresponding polygonal cross-sectional shape that is slightly larger than the cross-sectional shape of the collet nut to allow the collet nut to slide longitudinally within the longitudinal passage while inhibiting the collet nut from rotating about its axis within the longitudinal passage. The operator mechanism 10 may include other anti-rotation mechanisms or ways to inhibit rotation of the collet nut about its axis relative to the extender body as the extender body is rotated.

Each of the components of the operator mechanism 10 can be formed from any suitable material, including, but not limited to, metal and plastic. In one example, all of the components may be made from metal other than the button 16. The components may be formed from other suitable materials.

In use, as shown in FIGS. 4, 6, and 7 for example, the mount sleeve 28 extends through an opening 66 (FIG. 4) in the wall (e.g., the door) of the control enclosure 12, and the proximal and distal jam nuts 30, 32, respectively, are tightened against exterior and interior surfaces, respectively, of the wall of the control enclosure to mount the operator mechanism 10 on the wall. The length of the shaft assembly 22 is adjusted to account for the location of the switch in the control enclosure 12 that is operated by the operator mechanism 10. In one particular example, where the operator mechanism 10 is mounted on the door 14 (or movable wall) of the control enclosure 12 (as illustrated), the collet nut 62 may be slightly tightened on the collet 60 so that the collet frictionally engages the operator shaft 12 but allows sliding longitudinal movement of the shaft extender 18 on the operator shaft. With the door 14 open, such as shown in FIG. 7, the user slides the shaft extender 18 to a distal location on the operator shaft 17. The user then closes the door 14, allowing the distal end of the shaft extender 18 to contact the switch in the control enclosure 12, whereupon the shaft extender slides proximally along the operator shaft 17 as the door moves to its closed position (i.e., the length of the shaft assembly 22 shortens). The longitudinal position of the shaft extender 18 on the operator shaft 17 is generally the correct position of the shaft extender relative to the switch such that the shaft assembly has the desired and proper length when the button 16 is not depressed. The user then opens the door 14. The length of the shaft assembly 22 is generally maintained due to the frictional force of the collet 60 on the operator shaft 17. With the door open and the shaft extender 18 in its proper longitudinal position on the operator shaft 17, the user grasps and rotates the extender body 58 about the longitudinal axis L relative to the mount sleeve 28 and the collet nut 62 to further tighten the collet nut on the collet 60. With the collet nut 62 fully tightened on the collet 60, the shaft extender 18 is locked in its proper longitudinal position on the operator shaft 17. The door 14 can then be closed with the shaft assembly 22 having a proper length to actuate the switch in the control enclosure 12. It is understood that the operator mechanism 10 can be adjusted in length in other ways.

Figure 8:
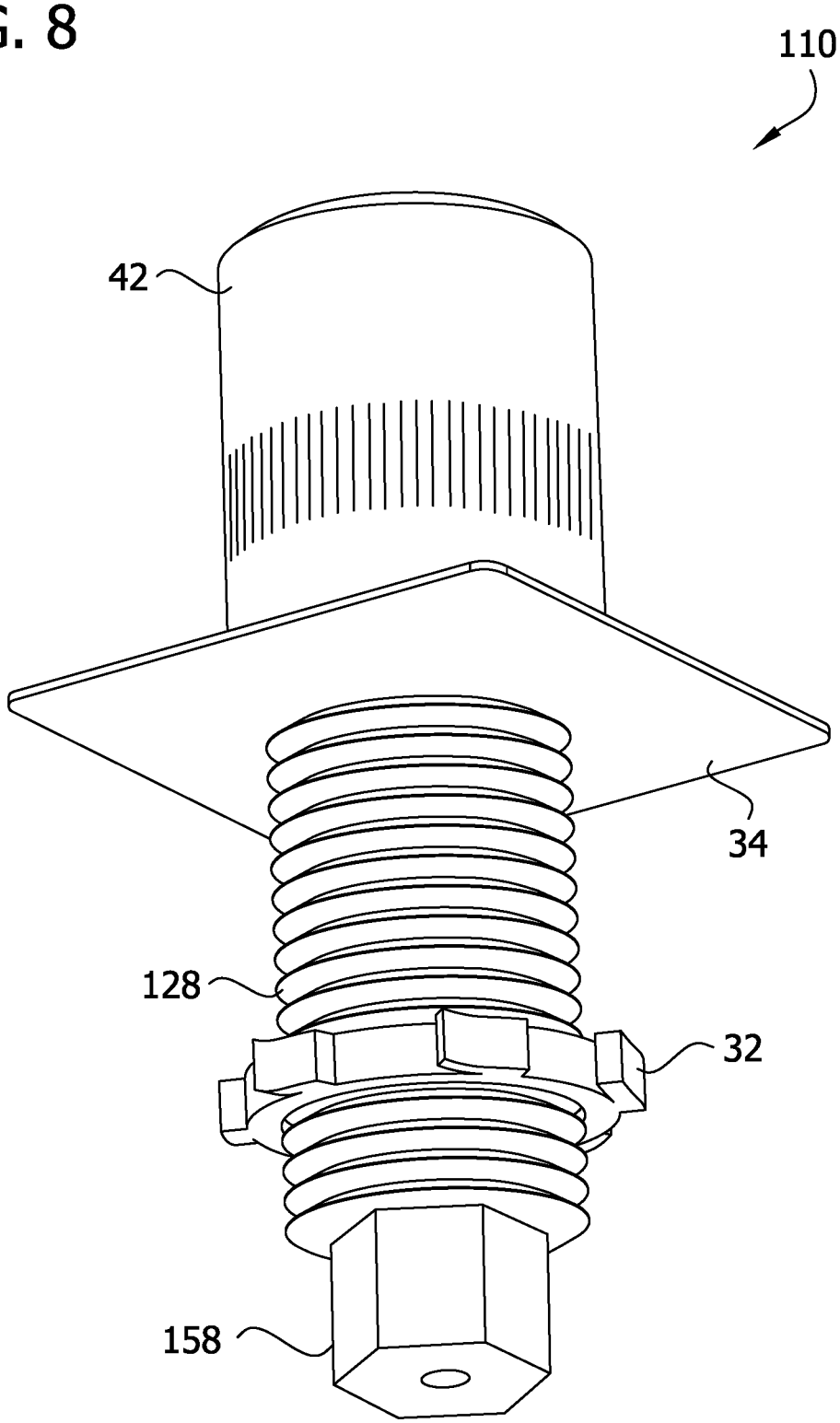
FIG. 8 is a perspective of another embodiment of an operator mechanism constructed according to the teachings of the present disclosure.
Figure 9:
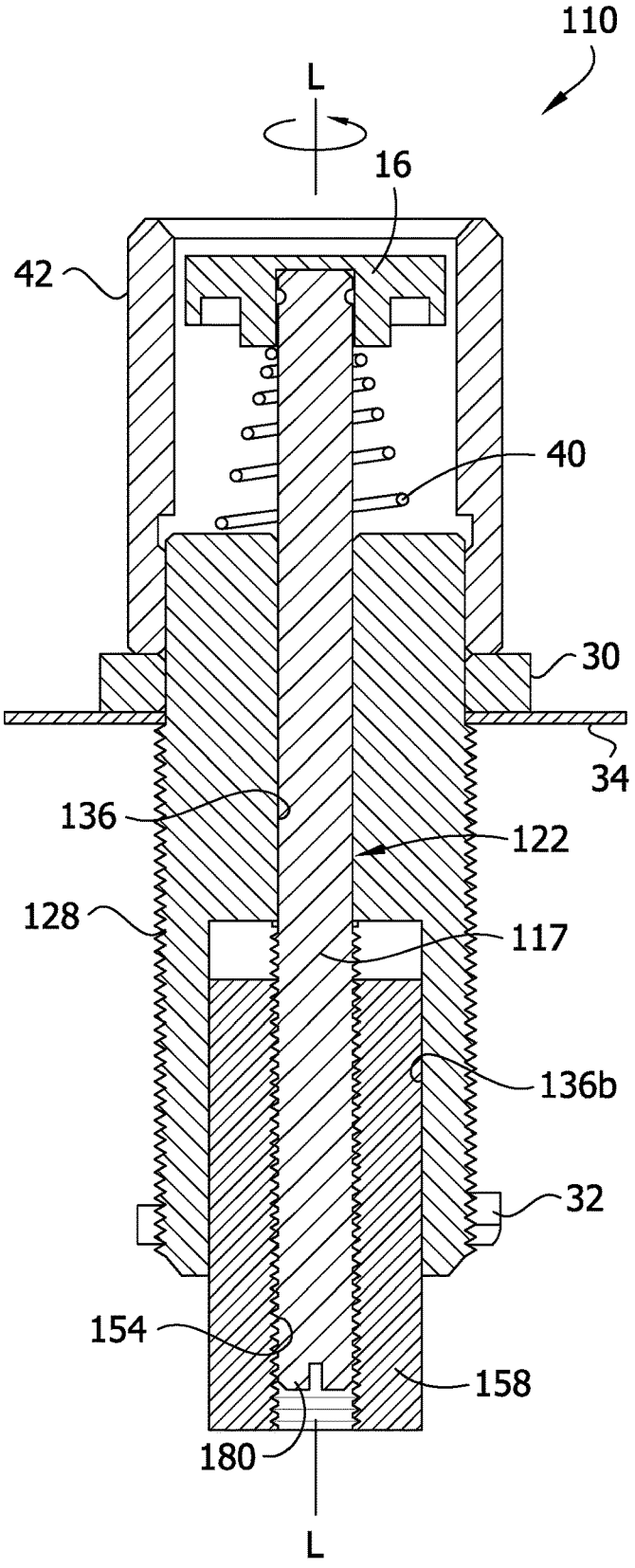
FIG. 9 is a longitudinal section of the operator mechanism of FIG. 8.

Referring to FIGS. 8 and 9, another embodiment of an operator mechanism is generally indicated at reference numeral 110. This embodiment includes the button 16, the spring 40, the button shroud 42, the jam nuts 30, 32, and the plate 34 of the first embodiment. Compared to the first embodiment, this operator mechanism 110 has a different mechanism for adjusting a length of a shaft assembly, generally indicated at 122. The illustrated shaft assembly 122 includes an operator shaft 117 with at least a distal longitudinal portion being externally threaded, and a shaft extender 158 having an extender body defining a passage 154 that is threaded. The extender body 158 is partially received in a distal portion 136*b* of a longitudinal passage 136 of an externally threaded mount sleeve 128 and extends distally outward therefrom. In the illustrated embodiment, the shaft extender 158 is inhibited from rotating about its longitudinal axis L relative to the mount sleeve 128 but is allowed to slide axially within the distal portion 136*b* of the longitudinal passage 136 of the mount sleeve. Because of this configuration and the threaded engagement between the operator shaft 117 and the shaft extender 158, rotation of the operator shaft about its longitudinal axis relative to the shaft extender imparts axial translational of the shaft extender within the longitudinal passage 146 of the mount sleeve 128. In other words, the operator mechanism 110 includes a rotary-to-translational motion mechanism. As illustrated, the shaft extender 158 has a polygonal exterior cross-sectional shape (e.g., hexagonal), and the distal portion 136*b* of the longitudinal passage 136 of the mount sleeve 128 has a corresponding polygonal cross-sectional shape that is slightly larger than the cross-sectional shape of the shaft extender to allow the shaft extender to move or slide longitudinally within the longitudinal passage while inhibiting the shaft extender from rotating about its axis within the longitudinal passage. The operator mechanism 110 may include other anti-rotation mechanisms or ways to inhibit rotation of the shaft extender relative to the sleeve as the shaft extender is rotated while allowing translational movement of the shaft extender in the sleeve.

In one example, to adjust the length of the shaft assembly 122, a user may rotate the button 16 or shaft 117 that is accessible outside the control enclosure to impart rotation of the operator shaft 117 relative to the shaft extender 158 and translation of the shaft extender relative to the mount sleeve 128. For example, rotating the button 16 clockwise may decrease the length of the shaft assembly 122, and rotating the button counterclockwise may increase the length of the shaft assembly. In another example, a user may use a tool to couple with the button 16 or the distal end of the operator shaft 117 to rotate the operator shaft about its axis relative to the shaft extender 158. In one embodiment, the distal end of the operator shaft 117 may include a slot 180 or other coupling feature for coupling with a flat head screwdriver or other tool. In another embodiment, the distal end of the operator shaft may include a Phillips coupling for coupling with a Phillips head screwdriver. Other types of couplings and tools are possible.

Figure 10:
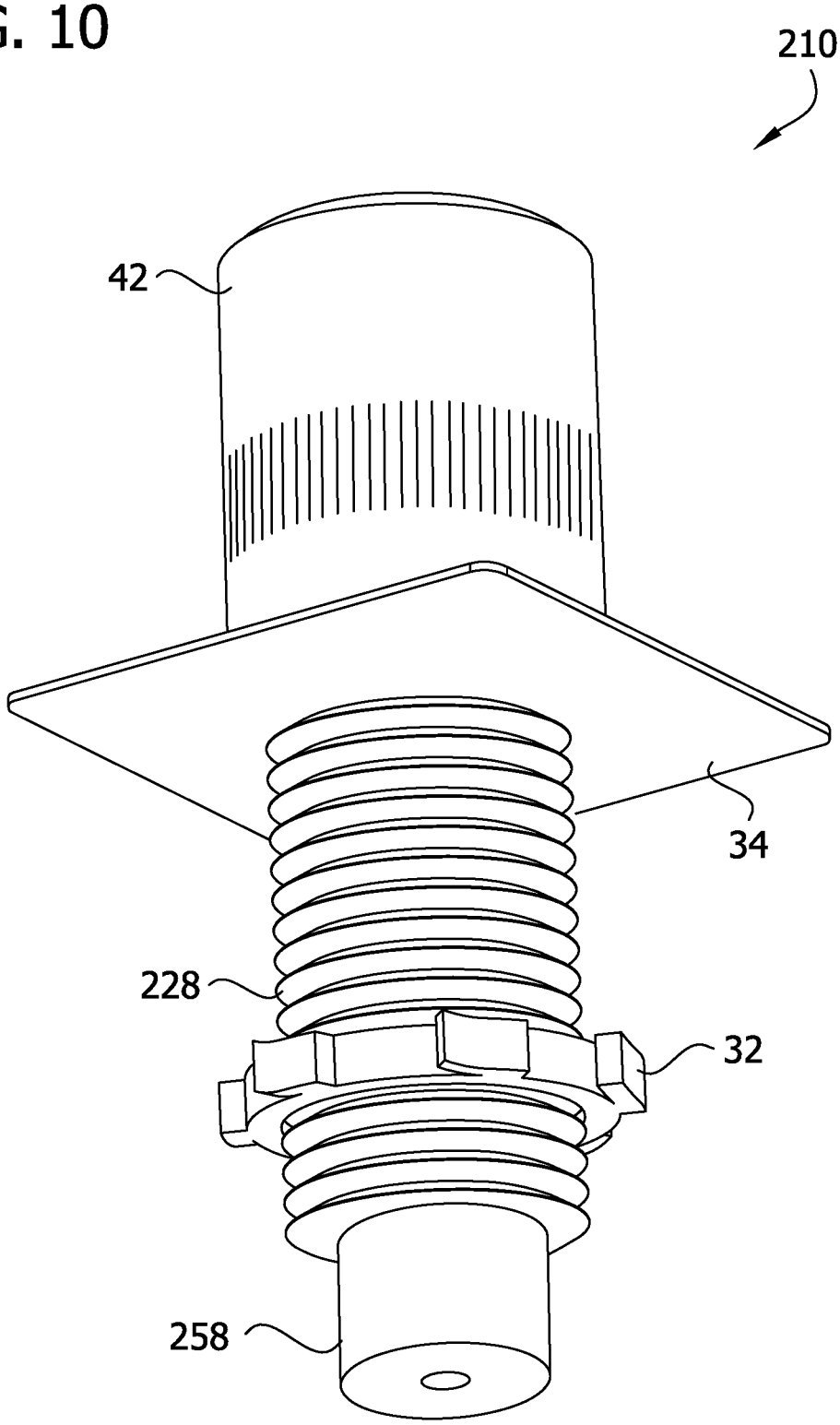
FIG. 10 is a perspective of another embodiment of an operator mechanism constructed according to the teachings of the present disclosure.
Figure 11:
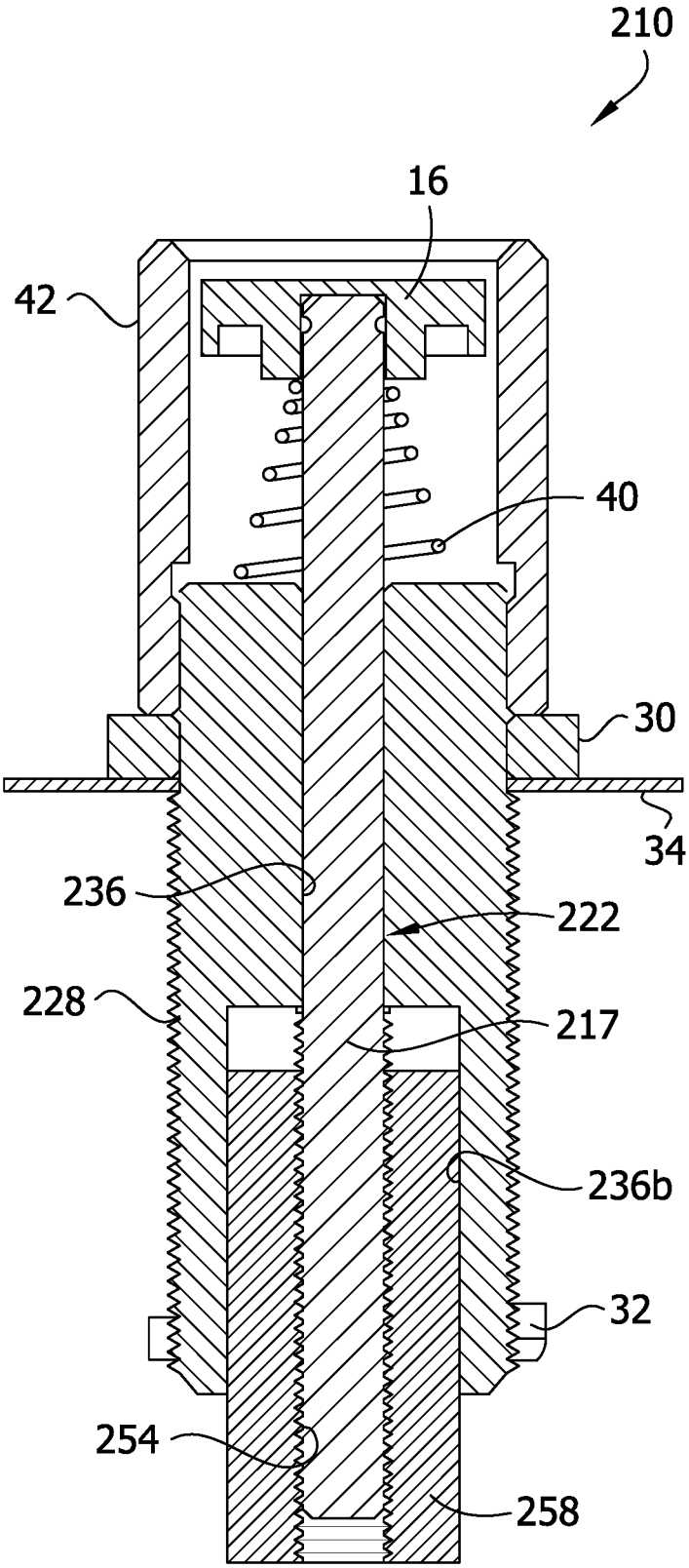
FIG. 11 is a longitudinal section of the operator mechanism of FIG. 10.

Referring to FIGS. 10 and 11, another embodiment of an operator mechanism is generally indicated at reference numeral 210. This embodiment includes the button 16, the spring 40, the button shroud 42, the jam nuts 30, 32, and the plate 34 of the first and second embodiments. Compared to the second embodiment, this operator mechanism 210 has a slightly different mechanism for adjusting a length of a shaft assembly 222. In particular, in this embodiment a shaft extender 258, which is threaded on a distal end of an operator shaft 117 via a threaded longitudinal passage 254, is not inhibited from rotating about its axis in a distal portion 236*b* of a longitudinal passage 236 of the mount sleeve 228. One or both of the shaft extender 258 and the threaded longitudinal passage 254 may include an interference thread to inhibit unintentional rotation of the shaft extender on the operator shaft, thereby inhibiting unintentional longitudinal displacement of the shaft extender on the operator shaft. In the illustrated embodiment the shaft extender 258 has a circular exterior cross section and the distal portion 236*b* of the longitudinal passage 236 of the mount sleeve 228 has a circular exterior cross section larger than the cross section of the shaft extender. In this embodiment, it is envisioned that the user will grip the shaft extender 258 while rotating the operator shaft 217 (e.g., by rotating the button 16 or using a tool coupled to the distal end of the operator shaft 217) to allow the operator shaft to rotate relative to the shaft extender so that the shaft extender longitudinally translates. Like the second embodiment, the button 16 or the distal end of the operator shaft 217 may include a coupling (e.g., a slot for a flat head screwdriver or Phillips slot for a Phillips head screwdriver) for coupling with a tool.

Referring to FIG. 12, another embodiment of an operator mechanism is generally indicated at reference numeral 310. This embodiment is configured as a rotary operator mechanism. The rotary operator mechanism 310 includes a mount sleeve 328, which is externally threaded, for mounting the rotary operator mechanism to a door or wall of an enclosure, such as the door 14 or the enclosure 12. An operator shaft assembly, generally indicated at 322, extends longitudinally through a longitudinal passage 336 defined by the mount sleeve 328. The operator shaft assembly 322 has an adjustable operative length L3, as explained below. The operator shaft assembly 322 includes an operator shaft 317 and a shaft extender, generally indicated at 318, secured to the operator shaft adjacent a distal end of the operator shaft. A handle 316 extends laterally outward from a proximal end of the operator shaft 317. The handle 316 may be integrally formed with the operator shaft 317 or formed separately and secured thereto, such as by a suitable fastener.

The shaft extender assembly 318 is generally L-shaped including an extender shaft 358 secured to the operator shaft 317, and a switch actuating portion 359 extending laterally outward from the extender shaft. The switch actuating portion 359 is suitable for actuating a switch, e.g., a breaker switch, within the enclosure. In one example, the switch actuating portion 359 has a forked free end for engaging the breaker switch. The shaft extender assembly 318 is received in a longitudinal passage 364 of the operator shaft 317 and selectively slidable longitudinally along a distal end portion of the operator shaft to adjust the operative length of the operator shaft assembly 322. The shaft extender assembly 318 is also selectively lockable at an infinite number of longitudinal locations along the length of the operator shaft 317 to inhibit longitudinal movement of the shaft extender assembly along the operator shaft to maintain the selected and desired length of the operator shaft assembly 322. In the illustrated embodiment, the shaft extender assembly 318 further includes a threaded collet 360 at a distal end of the operator shaft 317, and a collet nut 362 threaded on the collet. The illustrated collet 360 includes a plurality fingers 361 circumferentially spaced apart from one about the longitudinal axis of the shaft assembly 322. The fingers 361 are biased in a radially outward direction and movable radially inward relative to the longitudinal axis L of the operator shaft 317 to grip the extender shaft 358. Loosening the collet nut 362 on the collet 360 allows the fingers 361 to move toward its biased radially outward position to release or lessen its frictional grip on the extender shaft 358, which allows the shaft extender assembly 318 to be slidable longitudinally along the distal end portion of the operator shaft 317. Tightening the collet nut 362 on the collet 360 moves the fingers 361 radially inward toward the extender shaft 358 to grip and frictionally engage the shaft. The collet nut 362 can be tightened (or loosened) to one or more first positions so that the collet 360 grips the extender shaft 358 but still allows selective sliding longitudinal movement of the extender shaft 358 relative to the operator shaft 317 when a threshold force is applied to the shaft extender assembly 318. The collet nut 362 can be tightened to one or more second positions to tighten the grip of the collet 360 on the extender shaft 358 and inhibit sliding longitudinal movement of the extender shaft 358 in the operator shaft 317 during use (e.g., when the handle 316 is rotated to impart rotation of the shaft assembly 322 about its axis).

The extender shaft 358 may also be inhibited from rotating within the passage 364. In the illustrated embodiment, the geometries of the extender shaft 358 and the longitudinal passage 359 of the operator shaft 317 inhibit the shaft extender 318 from rotating about the axis of the extender shaft within the passage. As illustrated, the extender shaft 358 has a polygonal exterior cross-sectional shape (e.g., hexagonal), and the longitudinal passage 364 of the operator shaft 317 has a corresponding polygonal cross-sectional shape that is slightly larger than the cross-sectional shape of the extender shaft to allow the extender shaft to slide longitudinally within the longitudinal passage while inhibiting the extender shaft from rotating about the axis of the extender shaft within the longitudinal passage. The operator mechanism 310 may include other anti-rotation mechanisms or ways to inhibit rotation of the extender shaft about the axis of the extender shaft 358 within the passage 364.

As can be understood, the operative length L3 of the shaft assembly 322 can be adjusted by loosening and then tightening the collet nut 362 on the collet 360 so that the switch actuating portion 359 engages the switch in the enclosure. As with the first and second embodiments, the operator mechanism 310 can be secured to a door or other wall of an enclosure in a suitable manner, such as by using the mount sleeve 328 in the manner described above, so that the handle 316 is accessible outside the enclosure.

Referring to FIG. 13, another embodiment of an operator mechanism is generally indicated at reference numeral 410. Like the operator mechanism 310, this operator mechanism is configured as a rotary operator mechanism. The rotary operator mechanism 410 includes a mount sleeve 428, which is externally threaded, for mounting the rotary operator mechanism to a door or wall of an enclosure, such as the door 14 of the enclosure 12. An operator shaft assembly, generally indicated at 422, extends longitudinally through a longitudinal passage 436 defined by the mount sleeve 428. The operator shaft assembly 422 has an adjustable operative length L4, as explained below. The operator shaft assembly 322 includes an operator shaft 417 and a shaft extender, generally indicated at 418, secured to the operator shaft adjacent a distal end of the operator shaft. A handle 416 extends laterally outward from a proximal end of the operator shaft 417. The handle 416 may be integrally formed with the operator shaft or formed separately and secured thereto, such as by a suitable fastener.

Unlike the rotary operator mechanism 310, shaft extender assembly 418 of the present rotary operator mechanism 410 defines a longitudinal passage 454 in which the operator shaft 417 is received, similar to the first operator mechanism 10. The shaft extender assembly 418 includes a switch actuating portion 459 extending laterally outward relative to the operator shaft 417. The switch actuating portion 459 is suitable for actuating a switch, e.g., a breaker switch, within the enclosure. In one example, the switch actuating portion 359 has a forked free end for engaging the breaker switch. The shaft extender assembly 418 is selectively slidable longitudinally along a distal end portion of the operator shaft 417 to adjust the operative length of the shaft assembly 422. The shaft extender assembly 418 is also selectively lockable at an infinite number of longitudinal locations along the length of the operator shaft 417 to inhibit longitudinal movement of the shaft extender assembly along the operator shaft to maintain the selected and desired length of the shaft assembly 422. In the illustrated embodiment, the shaft extender 418 further includes a threaded collet 460 on the shaft extender assembly 418, and a collet nut 462 threaded on the collet. The collet 460 may be formed integrally with the shaft extender assembly 418 or may be formed separately and secured thereto. The illustrated collet 460 includes a plurality fingers 461 circumferentially spaced apart from one about the longitudinal axis of the shaft assembly 422. The fingers 461 are biased in a radially outward direction and movable radially inward relative to the longitudinal axis of the shaft assembly to grip the operator shaft 417. Loosening the collet nut 462 on the collet 460 allows the fingers 461 to move toward its biased radially outward position to release or lessen its frictional grip on the operator shaft 417, which allows the shaft extender assembly 418 to be slidable longitudinally along the distal end portion of the operator shaft 417. Tightening the collet nut 462 on the collet 460 moves the fingers 461 radially inward toward the operator shaft 417 to grip and frictionally engage the shaft. The collet nut 462 can be tightened (or loosened) to one or more first positions so that the collet 460 grips the operator shaft 417 but still allows selective sliding longitudinal movement of the shaft extender assembly 418 relative to the operator shaft 417 when a threshold force is applied to the shaft extender assembly. The collet nut 462 can be tightened to one or more second positions to tighten the grip of the collet 460 on the operator shaft 417 and inhibit sliding longitudinal movement of the shaft extender assembly 418 in the operator shaft 417 during use (e.g., when the handle 416 is rotated to impart rotation of the shaft assembly 422 about its axis).

The shaft extender 418 may also be inhibited from rotating on the operator shaft 417 about the axis of the shaft assembly 422. In the illustrated embodiment, the geometries of the distal end of the operator shaft 417 and the longitudinal passage 454 of the shaft extender 418 inhibit the shaft extender from rotating about the axis of the operator shaft 417. As illustrated, at least a distal end portion of the operator shaft 417 has a polygonal exterior cross-sectional shape (e.g., hexagonal), and the longitudinal passage 454 of the shaft extender 418 has a corresponding polygonal cross-sectional shape that is slightly larger than the cross-sectional shape of the operator shaft to allow the shaft extender to slide longitudinally on the operator shaft while inhibiting the shaft extender from rotating on the operator shaft. The operator mechanism 410 may include other anti-rotation mechanisms or ways to inhibit rotation of the shaft extender 418 on the operator shaft 417.

As can be understood, the operative length L4 of the shaft assembly 422 can be adjusted by loosening and then tightening the collet nut 462 on the collet 460 so that the switch actuating portion 459 engages the switch in the enclosure. As with the first, second, and third embodiments, the operator mechanism 410 can be secured to a door or other wall of an enclosure in a suitable manner, such as by using the mount sleeve 428 in the manner described above, so that the handle 416 is accessible outside the enclosure.

The operator mechanism may be of other types, besides push button and rotary operator mechanisms, that incorporate the teachings set forth herein for allow adjustment of the length of the shaft assembly.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An operator mechanism for a control enclosure, the operator mechanism comprising:

a mechanical user interface configured to be physically moved by a user to actuate the operator mechanism; and a shaft assembly coupled to the mechanical user interface such that movement of the mechanical user interface imparts movement to the shaft assembly, the shaft assembly having a length, wherein the shaft assembly includes:

an elongate operator shaft having a longitudinal axis extending distally outward from the mechanical user interface, and a shaft extender coupled to the operator shaft and having an axis extending along the operator shaft, the shaft extender including a collet and a collet nut threadably coupled to the collet, wherein the shaft extender is selectively slidable longitudinally along the operator shaft to selectively adjust the length of the shaft assembly by loosening the collet nut on the collet, and selectively lockable on the operator shaft to inhibit sliding of the shaft extender on the operator shaft to retain a selected length of the shaft assembly by tightening the collet nut on the collet.

2. The operator mechanism set forth in claim 1, wherein the shaft extender include an extender body configured to extend distally outward from a distal end of the operator shaft.

3. The operator mechanism set forth in claim 2, wherein the collet is disposed at a proximal end of the extender body.

4. The operator mechanism set forth in claim 3, wherein the extender body and the collet are rotatable about the axis of the shaft extender and relative to the shaft extender, wherein the collet nut is inhibited from rotating about the axis of the shaft extender when the extender body and the collet are selectively rotated about the axis of the shaft extender to selectively tighten and loosen the collet nut on the collet.

5. The operator mechanism set forth in claim 4, further comprising a mount sleeve configured to facilitate mounting of the operator mechanism on the control enclosure, wherein the mount sleeve defines a longitudinal passage through which the shaft assembly extends.

6. The operator mechanism set forth in claim 5, wherein the longitudinal passage of the mount sleeve includes a distal portion in which the shaft extender is at least partially received.

7. The operator mechanism set forth in claim 6, wherein cross-sectional sizes and shapes of the collet nut and the longitudinal passage of the mount sleeve inhibit the collet nut from rotating about the axis of the shaft extender when the extender body and the collet are rotated about the axis of the shaft extender relative to the operator shaft.

8. The operator mechanism set forth in claim 1, wherein the mechanical user interface comprises a push button.

9. The operator mechanism set forth in claim 1, wherein the mechanical user interface comprises a rotary handle.

10. An operator mechanism for a control enclosure, the operator mechanism comprising:

a mechanical user interface configured to be physically moved by a user to actuate the operator mechanism;

a shaft assembly coupled to the mechanical user interface such that movement of the mechanical user interface imparts movement to the shaft assembly, the shaft assembly having a length, wherein the shaft assembly includes:

an elongate operator shaft having a longitudinal axis extending distally outward from the mechanical user interface, and a shaft extender coupled to the operator shaft and having an axis extending along the operator shaft, wherein the shaft extender is selectively movable along the operator shaft to selectively adjust the length of the shaft assembly; and a mount sleeve to facilitate mounting of the operator mechanism on a wall of the control enclosure, wherein the mount sleeve defines a longitudinal passage extending therethrough, wherein the shaft extender is received in the longitudinal passage of the mount sleeve and extends distally outward from the mount sleeve, the shaft extender being selectively movable longitudinally within the longitudinal passage of the mount sleeve relative to the shaft operator to selectively adjust the length of the shaft assembly.

11. The operator mechanism set forth in claim 10, wherein the shaft extender is threadably coupled to the operator shaft by one or more interference threads.

12. The operator mechanism set forth in claim 11, wherein the operator shaft is rotatable about its longitudinal axis relative to the mount sleeve and the shaft extender to impart longitudinal movement of the shaft extender within the longitudinal passage of the mount sleeve relative to the operator shaft.

13. The operator mechanism set forth in claim 12, wherein the shaft extender is inhibited from rotating about its axis when the operator shaft is selectively rotated about its longitudinal axis relative to the mount sleeve.

14. The operator mechanism set forth in claim 13, wherein cross-sectional sizes and shapes of the shaft extender and the longitudinal passage of the mount sleeve inhibit the shaft extender from rotating about its axis when the operator shaft is selectively rotated about its longitudinal axis relative to the mount sleeve.

15. The operator mechanism set forth in claim 14, wherein the mechanical user interface comprises a push button.

16. The operator mechanism set forth in claim 15, wherein the push button is fixedly secured to the operator shaft and is rotatable about the longitudinal axis of the operator shaft to impart rotation to the operator shaft relative to the mount sleeve.

17. The operator mechanism set forth in claim 12, wherein the operator shaft includes a tool coupling configured to couple to a tool that facilitates rotation of the operator shaft about its longitudinal axis relative to the mount sleeve.

18. The operator mechanism set forth in claim 17, wherein at least one of a distal end of the operator shaft and a proximal end of the operator shaft defines the tool coupling.

19. The operator mechanism set forth in claim 10, wherein the shaft extender is selectively slidable longitudinally along the operator shaft to selectively adjust the length of the shaft assembly, and selectively lockable on the operator shaft to inhibit sliding of the shaft extender on the operator shaft to retain a selected length of the shaft assembly.

20. The operator mechanism set forth in claim 19, wherein the shaft extender includes a collet at a proximal end of the extender body, and a collet nut threadably coupled to the collet, wherein the shaft extender is selectively lockable on the operator shaft by tightening the collet nut on the collet, wherein the shaft extender is selectively slidable on the operator shaft by loosening the collet nut on the collet.

* * * * *